US011346245B2

(12) United States Patent
Gobrecht et al.

(10) Patent No.: US 11,346,245 B2
(45) Date of Patent: May 31, 2022

(54) METHOD FOR COOLING DOWN A STEAM TURBINE

(71) Applicant: Siemens Energy Global GmbH & Co. KG, Munich (DE)

(72) Inventors: Edwin Gobrecht, Ratingen (DE); Stefan Riemann, Kaarst (DE); Gerta Zimmer, Mülheim an der Ruhr (DE)

(73) Assignee: SIEMENS ENERGY GLOBAL GMBH & CO. KG, Munich (DE)

( * ) Notice: Subject to any disclaimer, the term of this patent is extended or adjusted under 35 U.S.C. 154(b) by 986 days.

(21) Appl. No.: 15/123,185

(22) PCT Filed: Jan. 28, 2015

(86) PCT No.: PCT/EP2015/051660
§ 371 (c)(1),
(2) Date: Sep. 1, 2016

(87) PCT Pub. No.: WO2015/135681
PCT Pub. Date: Sep. 17, 2015

(65) Prior Publication Data

US 2017/0067364 A1 Mar. 9, 2017

(30) Foreign Application Priority Data

Mar. 12, 2014 (EP) ..... 14159049

(51) Int. Cl.
*F01D 25/12* (2006.01)
*F01K 13/02* (2006.01)
(Continued)

(52) U.S. Cl.
CPC ..... *F01D 25/12* (2013.01); *F01D 25/32* (2013.01); *F01K 13/025* (2013.01); *F01D 5/005* (2013.01);
(Continued)

(58) Field of Classification Search
CPC ..... F01D 25/12; F01D 25/14; F01D 25/08; F01D 25/24; F01D 25/32; F01D 25/30
(Continued)

(56) References Cited

U.S. PATENT DOCUMENTS 6,048,169 A 4/2000 Feldmueller et al.
6,102,654 A 8/2000 Feldmueller et al.
(Continued)

FOREIGN PATENT DOCUMENTS

AU 2008202733 A1 * 1/2009 ..... F01D 25/12
AU 2008202733 A1 1/2009
(Continued)

OTHER PUBLICATIONS

RU Office Action dated Nov. 9, 2017, for RU patent application No. 2016139666.
(Continued)

*Primary Examiner* — Kenneth Bomberg
*Assistant Examiner* — Adam W Brown

(57) ABSTRACT

A steam-turbine unit has a steam turbine and an option for cooling the steam turbine by forced cooling, wherein cooling air is drawn through the steam turbine via a suction device and a drainage line of the live-steam valve is used as the access option.

12 Claims, 3 Drawing Sheets

(51) Int. Cl.
*F01D 25/32* (2006.01)
*F01D 5/00* (2006.01)

(52) U.S. Cl.
CPC ..... *F05D 2220/31* (2013.01); *F05D 2240/14* (2013.01); *F05D 2260/232* (2013.01)

(58) Field of Classification Search
USPC ..... 415/116
See application file for complete search history.

(56) References Cited

U.S. PATENT DOCUMENTS 6,145,317 A * 11/2000 Gobrecht ..... F01D 25/12 415/116
6,272,861 B1 8/2001 Bergmann

FOREIGN PATENT DOCUMENTS

| | | | |
|---|---|---|---|
| CN | 1231714 | A | 10/1999 |
| CN | 1231715 | A | 10/1999 |
| CN | 103195508 | A | 7/2013 |
| DE | 19640298 | A1 | 4/1998 |
| DE | 19823251 | C1 | 7/1999 |
| JP | S58220907 | A | 12/1983 |
| JP | H06193406 | A | 7/1994 |
| JP | 2001500943 | A | 1/2001 |
| KR | 20000048655 | A | 7/2000 |
| RU | 2182975 | C2 | 5/2002 |

OTHER PUBLICATIONS

KR Notice of Allowance dated Nov. 28, 2017, for KR patent application No. 1020167024681.
CN Office Action dated Feb. 27, 2017, for CN patent application No. 201580013082.6.
EP Search Report, dated Oct. 2, 2014, for EP application No. 14159049.7.
International Search Report, dated Feb. 4, 2016, for PCT application No. PCAT/EP2015/051660.
JP Notice of Allowance dated Dec. 25, 2017, for JP patent application No. 2016556861.

* cited by examiner

METHOD FOR COOLING DOWN A STEAM TURBINE

CROSS REFERENCE TO RELATED APPLICATIONS

This application is the US National Stage of International Application No. PCT/EP2015/051660 filed Jan. 28, 2015, and claims the benefit thereof. The International Application claims the benefit of European Application No. EP14159049 filed Mar. 12, 2014. All of the applications are incorporated by reference herein in their entirety.

FIELD OF INVENTION

The invention relates to a steam turbine unit comprising a steam turbine which has a steam inlet region, an exhaust steam region and a blading region which is surrounded by a turbine housing and is arranged axially in between, and furthermore is designed with a suction device for sucking cooling fluid out of the turbine housing, wherein at least one cooling fluid inlet is provided which is closeable and openable by a closure member, is arranged upstream of the exhaust steam region—with respect to the flow direction of action steam flowing through the turbine housing during normal power operation—and through which, after a power cut-off, cooling fluid for cooling to a temperature below the operating temperature can be introduced into the turbine housing, wherein the steam turbine unit furthermore comprises a valve through which the cooling fluid flows, wherein the valve has a drainage device for draining the valve, wherein the drainage device comprises a drainage line.

BACKGROUND OF INVENTION

In a steam turbine, in particular a high pressure turbine or an intermediate pressure turbine with upstream resuperheating, temperatures of over 500° C. occur during a power operation. During such a power operation, which may last for some weeks or months, the turbine housing and also the turbine rotor and other turbine components, such as live steam valve, quick closure valve, turbine blades etc. are heated to a high temperature. After the entire steam turbine unit is shut down, the turbine rotor of a turbine can continue to be rotated at a reduced speed by means of a rotational device for a predetermined period of time and the steam atmosphere can be evaluated via an evacuation device. In order to be able to carry out maintenance or checking work and possible retrofitting work as soon as possible after the steam turbine has been shut down, it may be desirable under some circumstances to cool the steam turbine as rapidly as possible with predetermined limits for expansion differences occurring between turbine rotor and, for example, turbine housing being observed.

For this purpose, it has proven successful to put what is referred to as forced cooling into service. In this case, a cooling fluid is passed through the steam turbine via a suction device and introduction of air and, as a result, forced cooling is achieved. The procedure here is as follows: in the forced cooling situation, the exhaust steam region is coupled in terms of flow to a suction device and, at the live steam valve, the supply of cooling fluid is permitted via a plug or a small housing opening. The removal of the plug or the production of a small housing opening is comparatively awkward and requires a large amount of time. Furthermore, a live steam valve, because of its design, has to have a correspondingly small opening. Furthermore, a special tool is required for releasing the plug or the small housing opening.

SUMMARY OF INVENTION

The invention intends to provide a remedy for this and to specify an option as to how a cooling fluid can be supplied more simply for the forced cooling.

This object is achieved by a steam turbine unit comprising a steam turbine which has a steam inlet region, an exhaust steam region and a blading region which is surrounded by a turbine housing and is arranged axially in between, and furthermore is designed with a suction device for sucking cooling fluid out of the turbine housing, wherein at least one cooling fluid inlet is provided which is closeable and openable by a closure member, is arranged upstream of the exhaust steam region—with respect to the flow direction of action steam flowing through the turbine housing during normal power operation—and through which, after a power cut-off, cooling fluid for cooling to a temperature below the operating temperature can be introduced into the turbine housing, wherein the steam turbine unit furthermore comprises a valve through which the cooling fluid flows, wherein the valve has a drainage device for draining the valve, wherein the drainage device comprises a drainage line, wherein the drainage device has a junction which is connected in terms of flow to the cooling fluid inlet.

Furthermore, the object is achieved by a method for cooling a steam turbine having a turbine housing, in which, after a power cut-off, a cooling fluid inlet is connected in terms of flow to the turbine housing, and cooling fluid, in particular air, flowing through the cooling fluid inlet is conducted, while at the same time absorbing heat, through the turbine housing by means of a suction device in the direction of the action steam flowing through the steam turbine during the normal power operation, wherein the cooling fluid flows through a valve, characterized in that the valve has a drainage device through which the cooling fluid flows.

The invention therefore pursues the route of realizing the supply of air not via the plug or the small housing opening, but rather via an additional connection, which can be shut off, on the drainage line. Drainage lines are customarily arranged at a geodetically low point of the valve, wherein most valves have such a drainage line. According to the invention, it is now proposed to arrange a separate branch on the valve drain and to permit the supply of cooling air via said branch.

The awkward removal of the plug or the production of a small housing opening on the valve is therefore entirely dispensed with. Furthermore, no special tool for releasing the plug is required.

Advantageous developments are specified in the dependent claims.

In a first advantageous development, a cooling fluid line through which the cooling fluid flows and is sucked through the steam turbine via the suction device and leads to effective cooling is connected via the junction.

In an advantageous manner, the closure member is arranged in the cooling fluid line, wherein, advantageously, a second closure member is arranged in the cooling fluid line.

A second branch is arranged between the first closure member and the second closure member of the cooling fluid line, wherein the second branch is connected in terms of flow to a second drainage line, and a second drainage unit or a steam trap for draining the cooling fluid is arranged in said second drainage line.

In an advantageous manner, the second drainage line is connected in terms of flow to a condenser. The water which accumulates in the steam trap is therefore effectively conducted away.

The above-described properties, features and advantages of this invention and the manner in which they are achieved will become clearer and more clearly comprehensible in conjunction with the description below of the exemplary embodiments which are explained in more detail in conjunction with the drawings.

Exemplary embodiments of the invention are described below with reference to the drawings. The latter are not intended to illustrate the exemplary embodiments to scale; rather, the drawing where useful for the explanation is realized in schematized and/or slightly blurred form. With regard to additions to the teaching which is clearly visible in the drawing, reference is made to the relevant prior art.

DETAILED DESCRIPTION OF INVENTION

Figure 1:
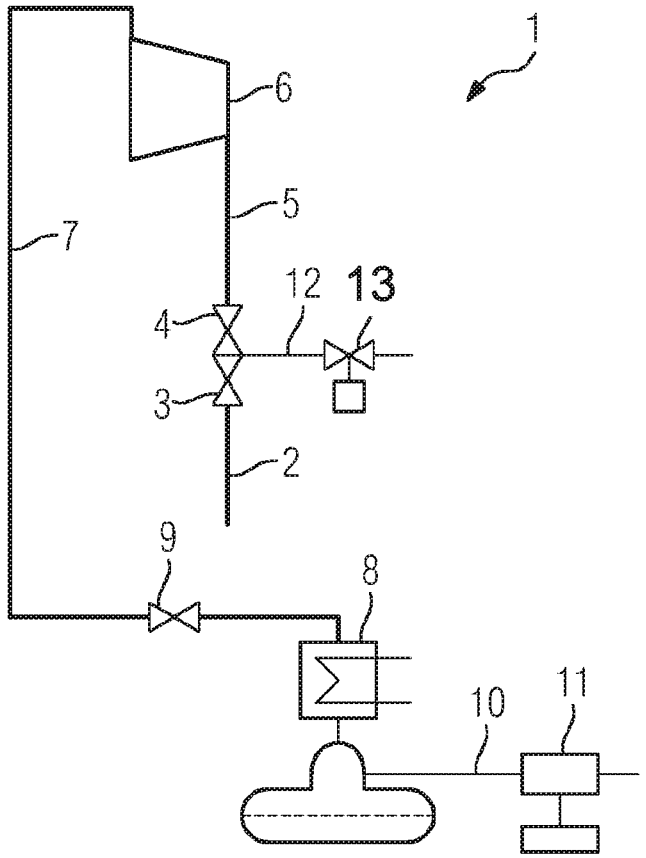
FIG. 1 shows a schematic illustration of the forced cooling.

FIG. 1 shows a schematic illustration of part of a steam turbine unit 1. Live steam flows via a steam generator (not illustrated specifically) into a first steam line 2 through a quick closure valve 3 and an adjusting valve 4. After the adjusting valve 4, the steam flows via a second steam line 5 into a steam turbine 6. The steam flows here into a steam inlet region (not illustrated specifically) and flows from an exhaust steam region out of the steam turbine 6 via a third steam line 7. The third steam line 7 is connected in terms of flow to a condenser 8, wherein a further valve 9 is arranged in the third steam line 7. The condenser 8 is connected in terms of flow via a line 10 to a suction device 11. Furthermore, a cooling fluid line 12 is arranged on the quick closing valve 3 or adjusting valve 4. A closure member 13 is arranged in the cooling fluid line 12.

During the forced cooling, the closure member 13 is opened and a cooling medium, such as, for example, cooling air, passes via the cooling fluid line 12 through the quick closing valve 3 or adjusting valve 4 into the second steam line 5 and from there into the blading region of the steam turbine 6. This forced flow takes place by the fact that the valve 9 is opened and a forced flow is achieved via the suction device 11.

Figure 2:
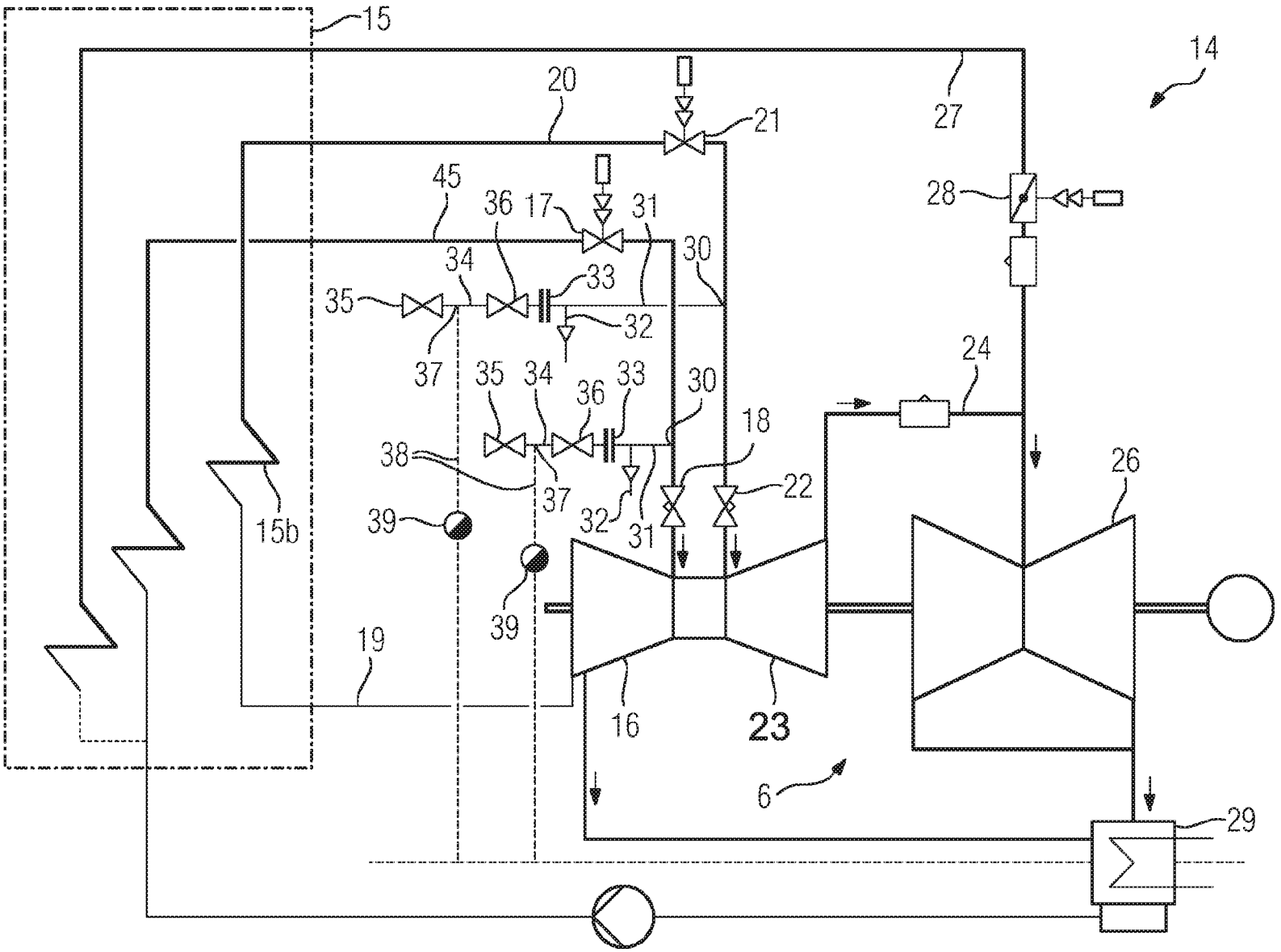
FIG. 2 shows a steam turbine unit.

FIG. 2 shows an expanded steam turbine unit 14. Live steam is produced here in a steam generator 15 and is supplied to a high pressure partial turbine 16 via a first live steam line 45. In the first live steam line 45, a first valve 17 and a second valve 18 are arranged successively. The live steam generated in the steam generator 15 flows here via the first live steam line 45 and the first valve 17 and second valve 18 into the high pressure partial turbine 16 and from there via an exhaust steam region and a first exhaust steam line 19 into the resuperheater of the steam generator 15.

In the steam generator 15, the steam flowing out of the high pressure partial turbine 16 is resuperheated, i.e. brought to a higher temperature, in a resuperheater 15*b* and is conducted via a hot superheater line 20 and a first intermediate pressure valve 21 and a second intermediate pressure valve 22 into an intermediate pressure partial turbine 23. The first intermediate pressure valve 21 is designed as a quick closing valve. The second intermediate pressure valve 22 is designed as a control valve.

The steam flowing out of the immediate pressure partial turbine 23 flows via an overflow line 24 into a low pressure partial turbine 26. The low-pressure partial turbine 26 is supplied with additional steam via an additional line 27 and an additional valve 28. The steam flowing out of the low pressure partial turbine 26 passes into a condenser 29 and condenses there to form water.

A junction 30 is arranged between the first valve 17 and the second valve 18. The first valve 17 is designed as a quick closing valve. The second valve 18 is designed as a control valve. A branch line 31 which leads into a drainage line 32 is arranged at said junction 30. The branch line 31 furthermore has a flange 33. A cooling fluid line 34 is coupled to said flange 33. A closure member which has a first closure member 35 and a second closure member 36 is arranged in said cooling fluid line 34. A second junction 37 is arranged between the first closure member 35 and the second closure member 36, wherein the second junction 37 is connected to a further branch line 38. A steam trap 39 for draining the steam in the further branch line 38 is arranged in said further branch line 38.

The hot superheater line 20 is of virtually identical design to the junction 30. A separate description has therefore been omitted, and the reference signs adopted for the forced cooling components located in the hot superheater line 20.

During normal operation, the steam flows into the high pressure partial turbine 16 via the first live steam line 45, wherein drainage is carried out via the junction 30 and the drainage line 32. The first closure member 35 and the second closure member 36 are closed here.

In the case of forced cooling, a supply of cooling medium to the first closure member 35 is permitted, wherein the first closure member 35 and the second closure member 36 are opened. The cooling medium may be cooling air. A double shut-off with intermediate low point drainage is referred to here. The double shut-off can either be integrated in a fully automized manner into the turbine process control technique or operated manually. In the second case, the double shut-off has to be provided with limit switches. It can thus be ensured that the starting of the steam turbine 6 takes place only when the fittings are closed. For the sake of clarity, the suction device 11 is not illustrated in FIG. 2. The suction device 11 would be coupled to the first closure member.

In a virtually identical manner, the intermediate pressure partial turbine 23 is likewise supplied with cooling medium. The cooling medium may be cooling air.

Figure 3:
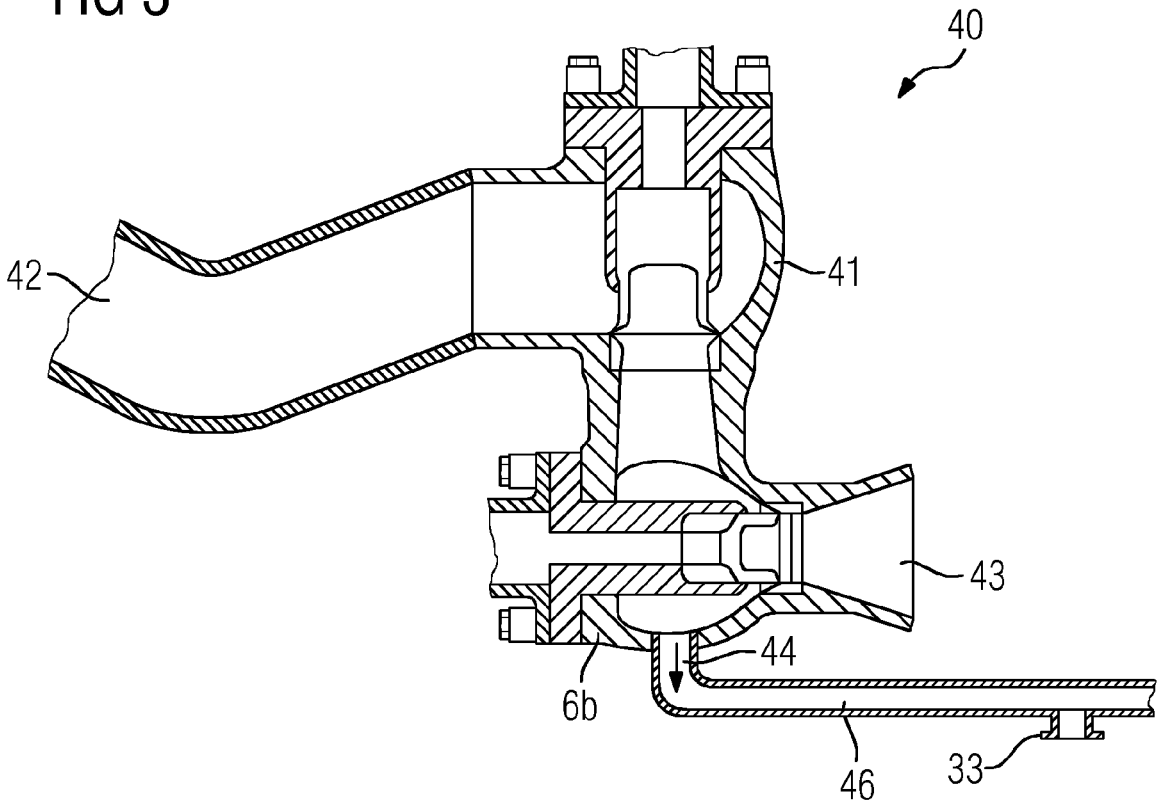
FIG. 3 shows a cross-sectional view of a valve.

FIG. 3 shows a cross-sectional view of a valve 40, which can be designed, for example, as second valve 18 or first valve 17. The valve 40 comprises a valve housing 41 and a valve cone (not illustrated specifically).

Steam flows via a valve inlet 42 through the valve 40 and passes via the valve outlet 43 to the high pressure partial turbine 16 or low pressure partial turbine 23. A drain 44 is arranged at a geodetically favorable location. Said drain 44 is connected to a drainage line 46. A flange 33 to which the cooling fluid line 34 is connected is arranged in said drainage line 46.

Although the invention has been illustrated in more detail and described in detail by the preferred exemplary embodiment, the invention is not restricted by the disclosed examples and a person skilled in the art may derive other variations therefrom without departing from the scope of protection of the invention.

The invention claimed is:

1. A steam turbine unit comprising:

a steam turbine which comprises a steam inlet region, an exhaust steam region and a blading region which is surrounded by a turbine housing and is arranged axially in between, a cooling fluid inlet which is closeable and openable by a closure member, and which is arranged upstream of the exhaust steam region with respect to a flow direction of steam, a valve comprising a steam inlet and a steam outlet, and a drainage device comprising: a junction that is disposed downstream of the steam inlet and upstream of the steam turbine; and a drainage device line that connects the junction to the cooling fluid inlet and to a drain, wherein during normal power operation the steam flows through the valve, through the junction, and into the steam turbine, and the drainage device line leads drainage from the junction toward the drain in a drainage direction, and wherein during a cooling operation cooling fluid flows from the cooling fluid inlet, through the drainage device line in a direction opposite the drainage direction, to the junction, and then to the steam turbine.

2. The steam turbine unit as claimed in claim 1, further comprising a cooling fluid line from the cooling fluid inlet to the drainage device line through which the cooling fluid flows.

3. The steam turbine unit as claimed in claim 2, wherein the closure member is arranged in the cooling fluid line.

4. The steam turbine unit as claimed in claim 2, wherein a second closure member is arranged in the cooling fluid line.

5. The steam turbine unit as claimed in claim 4, wherein, between the closure member and the second closure member, the cooling fluid line comprises a second junction.

6. The steam turbine unit as claimed in claim 5, wherein the second junction is connected in terms of flow to a second drainage line, and a second drainage device or a steam trap for draining the cooling fluid line is arranged in said second drainage line.

7. The steam turbine unit as claimed in claim 6, wherein the second drainage line is connected in terms of flow to a condenser.

8. A method for cooling the steam turbine unit of claim 1, the method comprising:

after a power cut-off, performing a cooling operation by conducting the cooling fluid flowing through the cooling fluid inlet, through the drainage device line in the direction opposite the drainage direction, through the junction, and then through the steam turbine while at the same time absorbing heat, through the turbine housing.

9. The method as claimed in claim 8, wherein the cooling fluid flows via a closure member in a cooling fluid line that connects the cooling fluid inlet to the drainage device line.

10. The method as claimed in claim 9, further comprising:

arranging a second closure member in the cooling fluid line, and wherein the cooling fluid line between the closure member and the second closure member comprises a second junction, arranging a second drainage device or steam trap in a second drainage line which is connected in terms of flow to the second junction.

11. The method as claimed in claim 10, wherein the closure member and the second closure member comprise limit switches, and starting of the steam turbine is possible only with closure member closed and second closure member closed.

12. The method as claimed in claim 8, wherein the cooling fluid comprises air.

* * * * *